US008205806B2

(12) United States Patent
Mak et al.

(10) Patent No.: US 8,205,806 B2
(45) Date of Patent: Jun. 26, 2012

(54) MISTING FAN

(75) Inventors: Chi Kin John Mak, Hong Kong (HK); Anton Whiley, Hong Kong (HK)

(73) Assignee: Chi Kin John Mak, Hong Kong (HK)

( * ) Notice: Subject to any disclaimer, the term of this patent is extended or adjusted under 35 U.S.C. 154(b) by 460 days.

(21) Appl. No.: 12/484,161

(22) Filed: Jun. 12, 2009

(65) Prior Publication Data

US 2010/0264235 A1 Oct. 21, 2010

(30) Foreign Application Priority Data

Apr. 16, 2009 (CN) ..... 2009 2 0130768 U

(51) Int. Cl.
*B05B 3/02* (2006.01)

(52) U.S. Cl. ..... 239/215; 239/289

(58) Field of Classification Search ..... 239/215, 239/214.21, 222.11, 289, 302, 355, 360; 261/28, 89, 90, 78.2, DIG. 3
See application file for complete search history.

(56) References Cited

U.S. PATENT DOCUMENTS

| | | | | |
|---|---|---|---|---|
| 2,163,474 A | | 6/1939 | Sloan | |
| 2,243,114 A | * | 5/1941 | Ness et al. | 62/419 |
| 2,716,306 A | | 8/1955 | Lear | |
| 2,776,167 A | | 1/1957 | Koch | |
| 3,878,989 A | | 4/1975 | Jenkins | |
| 4,034,915 A | | 7/1977 | Garner | |
| 4,657,712 A | | 4/1987 | Milbocker | |
| 5,338,495 A | * | 8/1994 | Steiner et al. | 261/28 |
| 5,752,662 A | * | 5/1998 | Hsu | 239/215 |
| 5,965,067 A | | 10/1999 | Junkel et al. | |
| 6,244,576 B1 | * | 6/2001 | Tsai | 261/141 |
| 6,827,290 B2 | * | 12/2004 | Zimmerman | 239/215 |
| 2004/0089745 A1 | | 5/2004 | Zimmerman | |
| 2005/0006497 A1 | | 1/2005 | Polak | |
| 2005/0086967 A1 | | 4/2005 | Pavlik | |
| 2006/0086821 A1 | | 4/2006 | Junkel et al. | |
| 2006/0273195 A1 | | 12/2006 | Junkel | |

FOREIGN PATENT DOCUMENTS

| | | |
|---|---|---|
| GB | 893694 | 4/1962 |
| WO | 97/06882 | 2/1997 |
| WO | 00/72975 | 12/2000 |
| WO | 03/066168 | 8/2003 |

* cited by examiner

*Primary Examiner* — Davis Hwu

(57) ABSTRACT

A misting fan includes a rotatable fan blade collar, a plurality of fan blades mounted around the rotatable fan blade collar, a mist-generating assembly, a drive mechanism and a motor. The mist-generating assembly includes a mist nozzle disposed inside the fan blade collar and a hose with one end being coupled to the nozzle. The motor includes a motor shaft for rotating the fan blade collar through the drive mechanism. An axis of rotation of the motor shaft is offset from an axis of rotation of the fan blade collar.

4 Claims, 7 Drawing Sheets

MISTING FAN

CROSS-REFERENCE TO RELATED PATENT APPLICATIONS

This application claims priority of Chinese patent application No. 200920130768.5 filed on Apr. 16, 2009, the entire content of which is hereby incorporated by reference.

FIELD OF PATENT APPLICATION

The present patent application relates to a fan and in particular a misting fan having mist-generating capacity.

BACKGROUND

Electric fans can bring cool air to users in hot summer. When an electric fan is equipped with a mist-generating device, mist so formed can be blown in the air by the fan towards the face and body of a user. This can bring extra coolness to the user.

In conventional misting fans equipped with mist-generating device, fan blades are directly mounted on the shaft of a motor. Therefore, it is impossible to put a mist nozzle at the center point of the fan blades. There are two designs in the location of a mist nozzle in existing misting fans. In one design, the nozzle is located behind the fan blades within the circumference thereof. One disadvantage of this design is that the mist dispensing from the nozzle has to pass through the rotating fan blades before spraying onto the user. Hence, the rotating fan blades block most of the mist from passing through and affect the mist spraying and cooling effect. Furthermore, mist hitting the fan blades condenses into water droplets which will be splashed out in all directions by the rotating fan blades. In another design, the nozzle is located outside the circumference of the fan blades. The disadvantage of this design is that the mist coming out of the nozzle is far away from the center of the airflow generated by the fan. This reduces the cooling effect of the mist.

The above description of the background is provided to aid in understanding a misting fan, but is not admitted to describe or constitute pertinent prior art to the misting fan disclosed in the present application, or consider any cited documents as material to the patentability of the claims of the present application.

SUMMARY

In one aspect, a misting fan is provided. The misting fan includes a rotatable fan blade collar, a plurality of fan blades mounted around the rotatable fan blade collar, a mist-generating assembly, a drive mechanism and a motor. The mist-generating assembly includes a mist nozzle disposed inside the fan blade collar and a hose with one end being coupled to the nozzle. The motor includes a motor shaft for rotating the fan blade collar through the drive mechanism. An axis of rotation of the motor shaft is offset from an axis of rotation of the fan blade collar.

The fan blade collar may be rotated around the nozzle.

A central axis of the fan blade collar may generally be parallel to a central axis of the nozzle.

The mist-generating assembly may include a container and a pump coupled to the container for pumping liquid out of the container.

In one embodiment, the drive mechanism includes first and second meshing gears mounted on the motor shaft and the fan blade collar respectively. In another embodiment, the drive mechanism includes first and second gears mounted on the motor shaft and the fan blade collar respectively, and a third intermediate gear meshing with the first and second gears. In yet another embodiment, the drive mechanism includes first and second gears mounted on the motor shaft and the fan blade collar respectively, and a synchronizing belt for driving the first and second gears to rotate. In yet another embodiment, the drive mechanism includes first and second belt-pulleys mounted on the motor shaft and the fan blade collar respectively, and a belt looping over and driving the first and second belt-pulleys to rotate.

In another aspect, a mist-spraying device is provided. The mist-spraying device includes a motorized fan and a mist sprayer. The motorized fan includes a rotatable fan blade collar and a plurality of fan blades mounted around the rotatable fan blade collar. The mist sprayer includes a mist nozzle disposed inside the fan blade collar for dispensing mist therefrom substantially at a center point of the fan blades.

The mist-spraying device may further include a drive mechanism and a motor for rotating the fan blade collar through the drive mechanism. An axis of rotation of a motor shaft of the motor is offset from an axis of rotation of the fan blade collar. In one embodiment, the drive mechanism includes first and second meshing gears mounted on the motor shaft and the fan blade collar respectively. In another embodiment, the drive mechanism includes first and second gears mounted on the motor shaft and the fan blade collar respectively, and a third intermediate gear meshing with the first and second gears. In yet another embodiment, the drive mechanism includes first and second gears mounted on the motor shaft and the fan blade collar respectively, and a synchronizing belt for driving the first and second gears to rotate. In yet another embodiment, the drive mechanism includes first and second belt-pulleys mounted on the motor shaft and the fan blade collar respectively, and a belt looping over and driving the first and second belt-pulleys to rotate.

In yet another aspect, a misting fan is provided. The misting fan includes a rotatable fan blade collar, a plurality of fan blades mounted around the rotatable fan blade collar, and a mist nozzle disposed inside the fan blade collar for dispensing mist therefrom.

The misting fan may further include a drive mechanism and a motor for rotating the fan blade collar through the drive mechanism. An axis of rotation of a motor shaft of the motor is offset from an axis of rotation of the fan blade collar.

The misting fan may further include a container and a pump coupled to the container for pumping liquid out of the container.

The misting fan may further include a hose with one end being coupled to the nozzle, and the other end being connected to a pump.

BRIEF DESCRIPTION OF THE DRAWINGS

Specific embodiments of the misting fan disclosed in the present patent application will now be described by way of example with reference to the accompanying drawings wherein.

DETAILED DESCRIPTION

Reference will now be made in detail to a preferred embodiment of the misting fan disclosed in the present application, examples of which are also provided in the following description. Exemplary embodiments of the misting fan disclosed in the present application are described in detail, although it will be apparent to those skilled in the relevant art that some features that are not particularly important to an understanding of the misting fan may not be shown for the sake of clarity.

Furthermore, it should be understood that the misting fan disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

Figure 1:
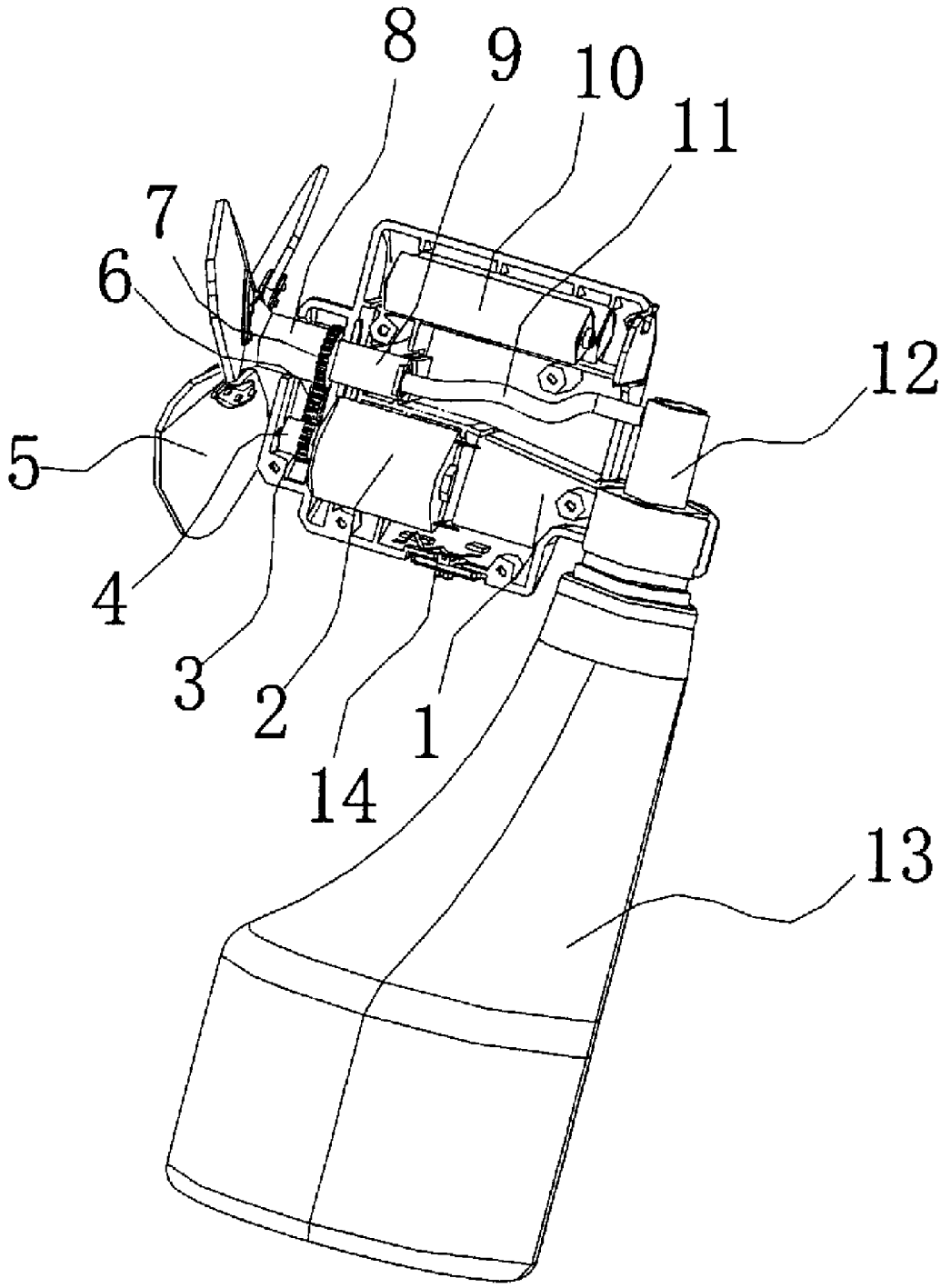
FIG. 1 is a rear perspective view of the misting fan with a cut-away housing to show the detailed internal structure of the misting fan according to an embodiment disclosed in the present application.

FIG. 1 is a rear perspective view of the misting fan with a cut-away portion to show the detailed inner structure according to an embodiment disclosed in the present patent application. The fan includes a plurality of fan blades 5 mounted around a rotatable fan blade collar 8. The fan blade collar 8 may be generally in the form of a tube having a front opening end and a rear opening end. The fan blade collar 8 has an outer surface on which the fan blades 5 can be fixedly mounted.

The misting fan includes a mist-generating assembly generally located behind the fan. The mist-generating assembly may include a mist nozzle 9 disposed inside the fan blade collar 8 in such a position that the nozzle opening is located substantially at the center of a front opening end of the fan blade collar 8. The mist-generating assembly may include a hose 11 with one end being connected to the mist nozzle 9. The other end of the hose 11 can be coupled to a pump 12.

An electric motor 2 is employed to drive the fan blade collar 8 to rotate through a drive mechanism. The motor 2 has a rotatable driving sleeve or shaft 4. The drive mechanism is employed to translate rotational motion of the driving motor shaft 4 to rotational motion of the driven fan blade collar 8. Details of different embodiments of the drive mechanism will be described hereinafter.

Figure 3:
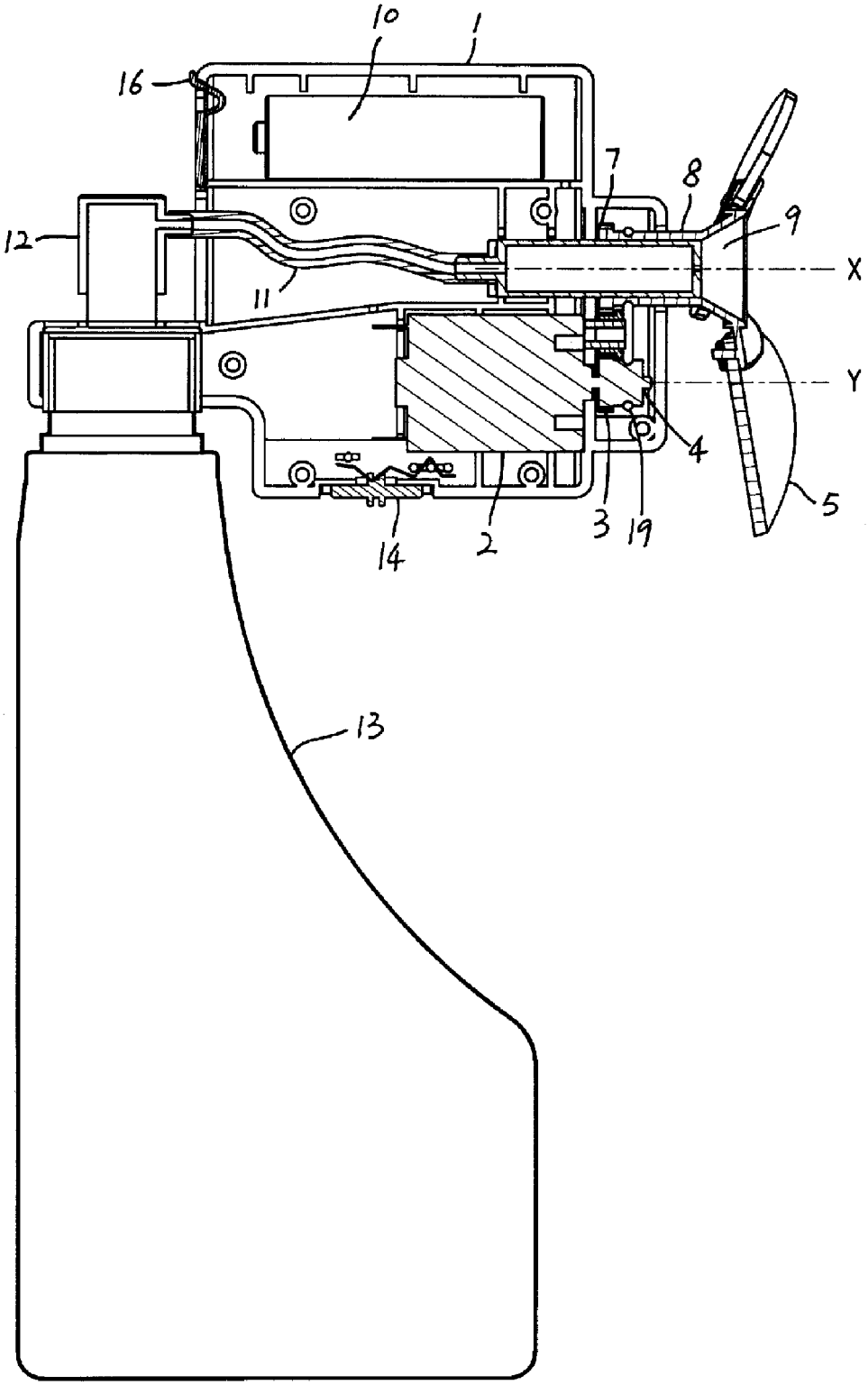
FIG. 3 is a cross sectional view of the misting fan.

As best illustrated in FIG. 3, the axis of rotation Y of the motor shaft 4 is offset from the axis of rotation X of the fan blade collar 8. According to the illustrated embodiment, the axis of rotation Y of the motor shaft 4 is parallel to the axis of rotation X of the fan blade collar 8.

The fan blade collar 8 may be rotatable around the nozzle 9 which is fixedly mounted in a housing 1. According to the illustrated embodiment, the central axis of the nozzle 9 may be parallel to the axis of rotation X of the fan blade collar 8 and the axis of rotation Y of the motor shaft 4.

Although it has been shown and described that the axis of rotation Y of the motor shaft 4 is offset from the axis of rotation X of the fan blade collar 8, and that the central axis of the motor shaft 4 is parallel to the axis of rotation of the fan blade collar 8, it is understood by one skilled in the art that the motor shaft 4 may be at any possible angle with respect to the axis of rotation of the fan blade collar 8. For example, the motor shaft 4 can be oriented perpendicular to the axis of rotation of the fan blade collar 8 using drive mechanism such as bevel gears. The motor shaft 4 can also be oriented at an acute angle or an obtuse angle with respect to the fan blade collar 8.

A battery 10 may be provided to supply electric power to the motor 2. The battery 10 can be received in a battery compartment integrally formed in the housing 1. A snap-fit cover 16 is used to cover the battery compartment and facilitate replacement of battery when necessary.

A switch 14 can be used to turn the motor 2 on or off by actuating the electric contact plate 15. The switch 14 can be electrically coupled in series with the motor 2 between the positive and negative terminals of the battery 10.

The mist-generating assembly may include a container 13 and a pump 12 for pumping water or other liquid out of the container 13 and into the hose 11. The pump 12 can be located at an upper opening of the container 13. It can be seen that one end of the hose 11 can be coupled to the nozzle 9 and the other end of the hose 11 can be coupled to the pump 12. The hose 11 may be flexible and received in the housing 1. The pump 12 is a manual pump.

Figure 4:
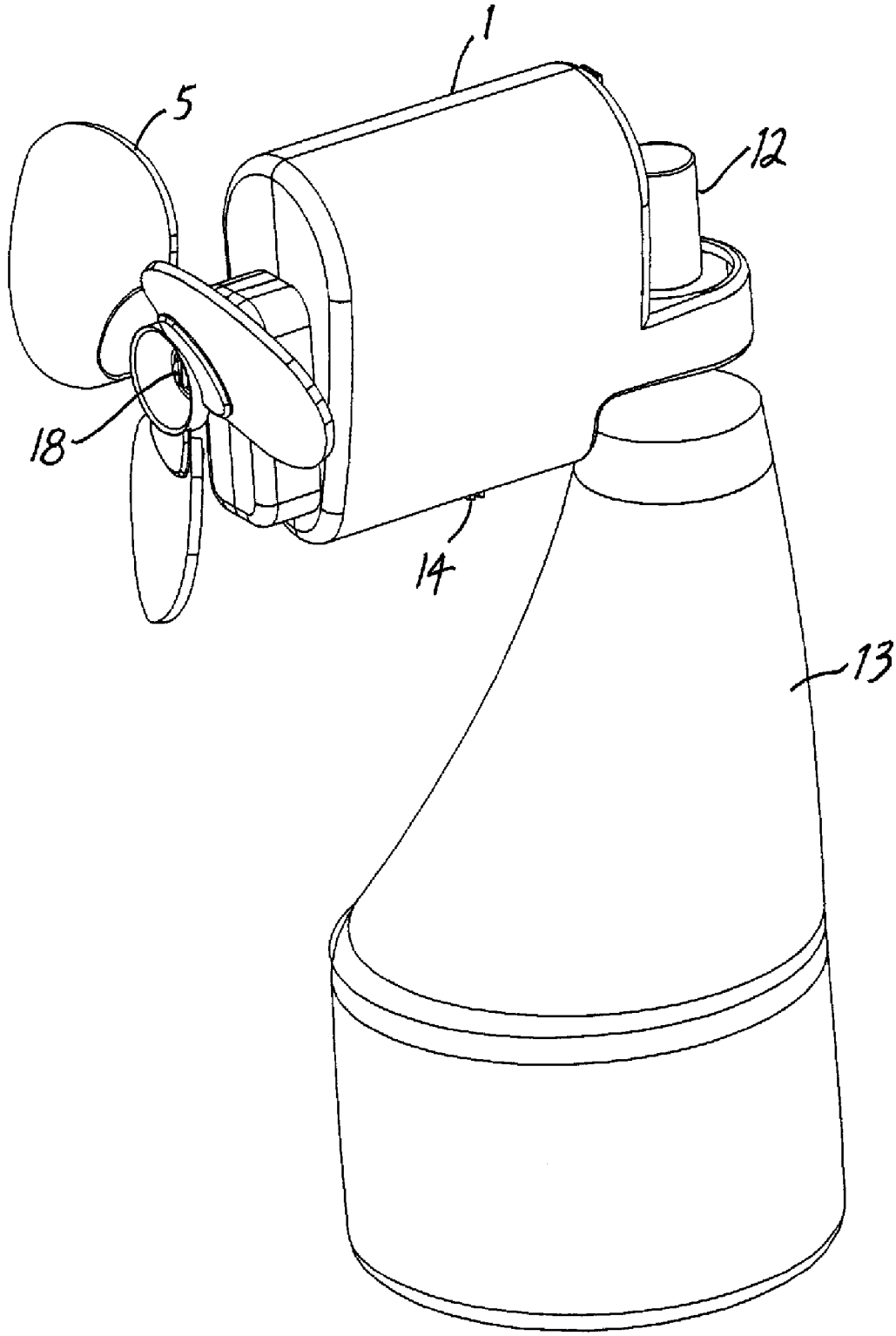
FIG. 4 is a front perspective view of the misting fan.
Figure 5:
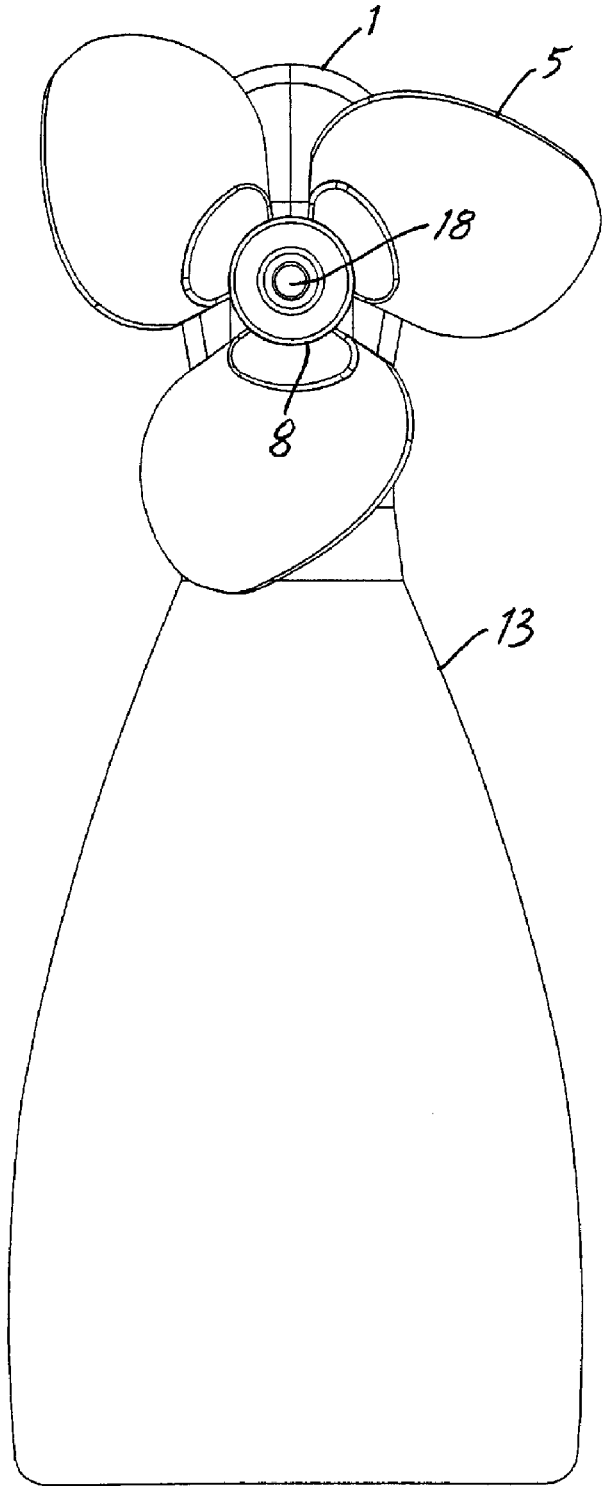
FIG. 5 is a front view of the misting fan.

When cool air is desired, a user can push the switch 14 from an OFF position to an ON position. The motor 2 is activated and the fan blades 5 start to rotate. When extra coolness is desired, the user can press the pump 12 to pump water out of the container 13, into the hose 11, and out of the mist nozzle 9 in the form of mist. Since the nozzle 9 is located substantially at the center point of the fan blades 5, as best illustrated in FIGS. 4 and 5, all of the mist coming out from the nozzle 9 can enter the center of the airflow generated by the rotating fan blades 5. Since the mist is formed in front of the rotating fan blades 5, it cannot be blocked in any way by the rotating fan blades as in some conventional misting fans.

Figure 2A:
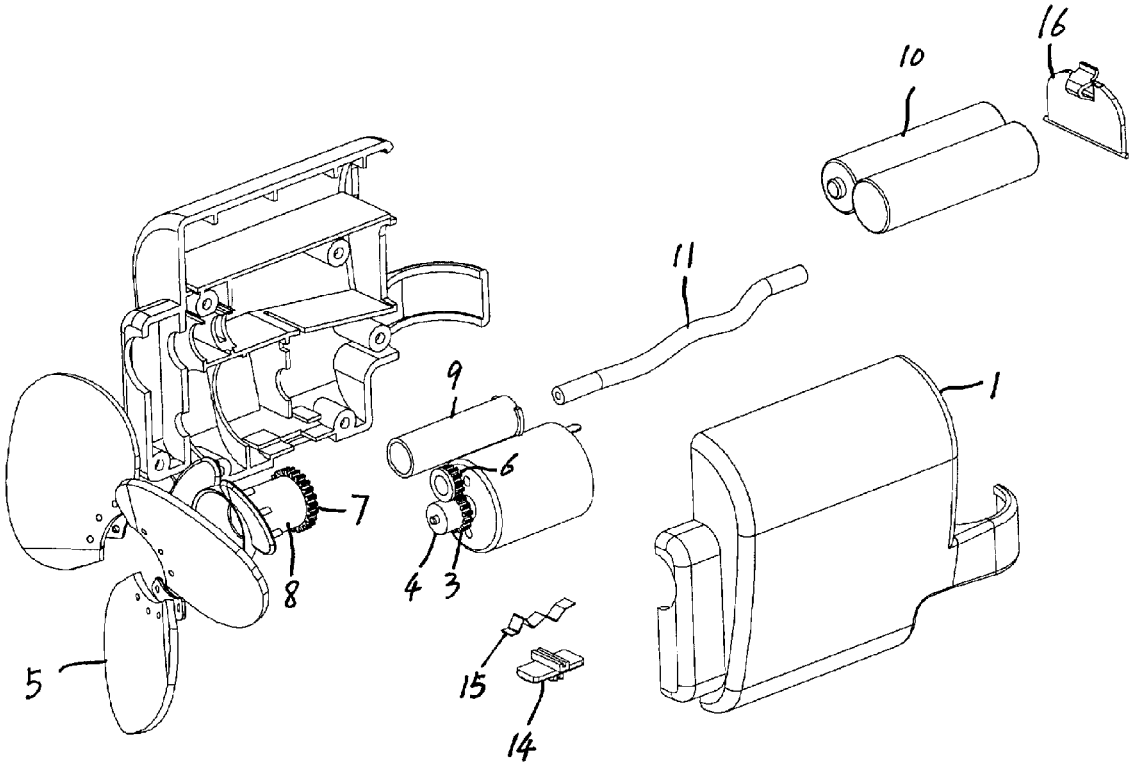
FIG. 2*a* is an exploded view of the misting fan with a drive mechanism according to an embodiment disclosed in the present application.

According to the embodiment illustrated in FIG. 2*a*, the drive mechanism may include a first gear 3 mounted on the motor shaft 4, and a second gear 7 mounted on the fan blade collar 8, and a third intermediate gear 6 meshing with the first and second gears 3, 7. The intermediate gear 6 can be rotatably mounted on the housing 1.

Although it has been shown and described that the drive mechanism has three meshing gears, it is understood by one skilled in the art that there may have more or less than three meshing gears. For example, the drive mechanism may have only two meshing gears. The first gear can be provided on the motor shaft 4 and the second gear can provided on the fan blade collar 8. The first gear can be directly meshed with the second gear rather than with a third intermediate gear, as depicted in the illustrated embodiment.

Figure 2B:
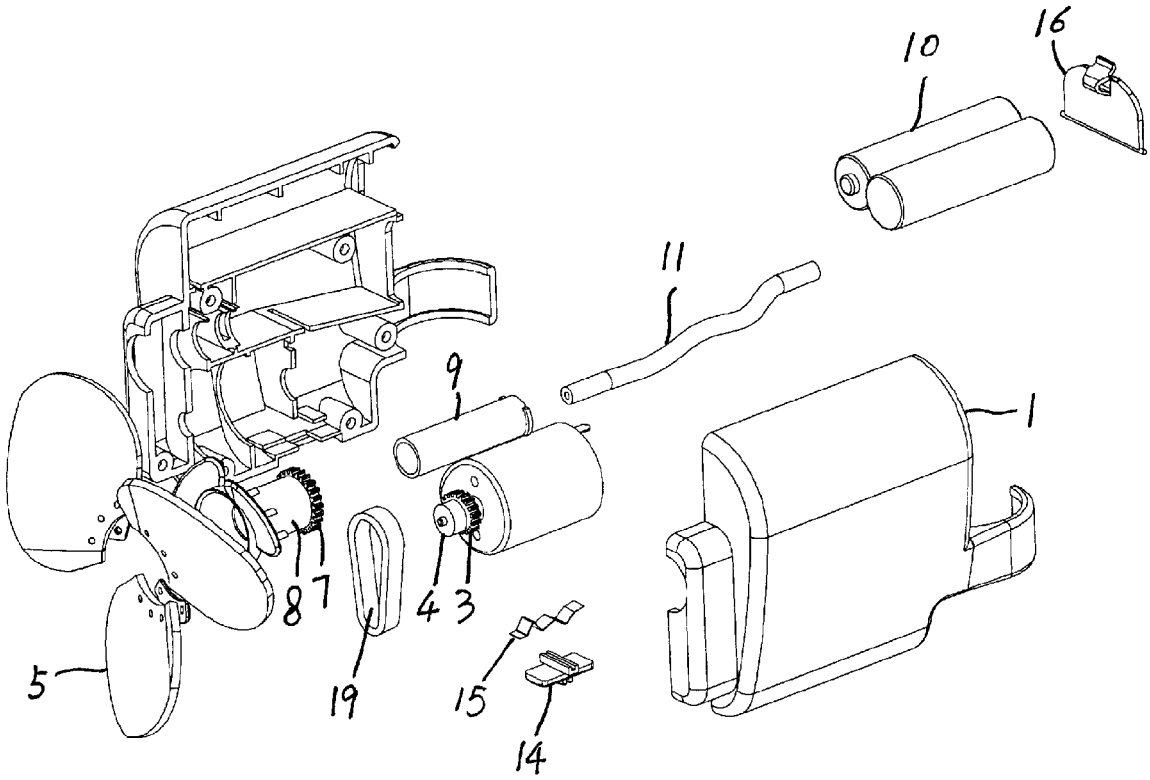
FIG. 2*b* is an exploded view of the misting fan with a drive mechanism according to another embodiment disclosed in the present application.

According to another embodiment illustrated in FIG. 2*b*, the drive mechanism may include a synchronizing belt 19 looping over and driving the first and second gear 3, 7 to rotate simultaneously.

Figure 2C:
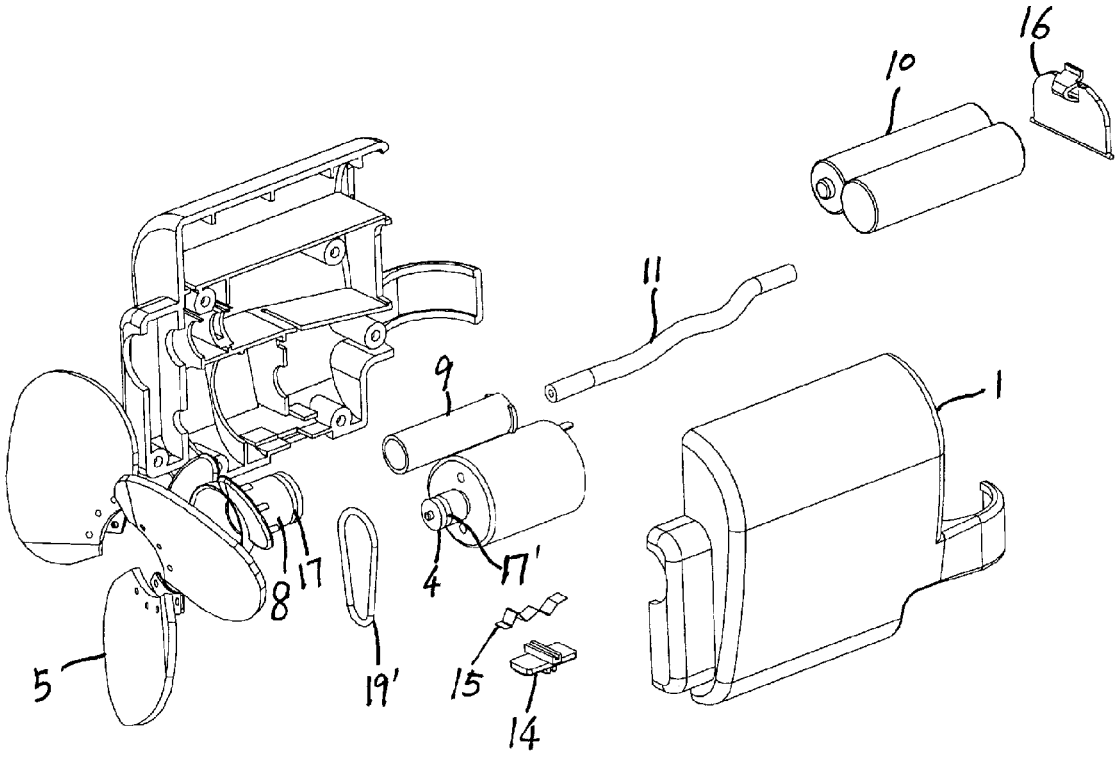
FIG. 2*c* is an exploded view of the misting fan with a drive mechanism according to yet another embodiment disclosed in the present application.

Although it has been shown and described that the drive mechanism is in the form of meshing gears, it is understood by one skilled in the art that the drive mechanism can be in any other suitable forms. For example, as illustrated in FIG. 2*c*, the drive mechanism may include first and second belt-pulleys mounted on the motor shaft 4 and the fan blade collar 8 respectively. Circumferentially extending grooves 17, 17' can be formed on the fan blade collar 8 and the motor shaft 4 respectively for receiving the belt 19'. The extending grooves of generally carry V-shaped cross section for receiving the belt. The V-shaped grooves can enhance the adherence between the belt-pulleys and the belt and prevent the belt from slipping out from the belt-pulleys. The use of belt-pulleys and belt may allow the motor 2 and the fan blade collar 8 to be closely packed together thereby reducing the size of the misting fan.

The misting fan disclosed in the present application is a compact portable misting fan. It may be made of plastic and is light in weight. The shape and size of the fan and the mist sprayer may vary to meet different markets and requirements in need and design.

While the misting fan disclosed in the present application has been shown and described with particular references to a number of preferred embodiments thereof, it should be noted that various other changes or modifications may be made without departing from the scope of the appending claims.

What is claimed is:

1. A misting fan comprising:

(a) a rotatable fan blade collar;

(b) a plurality of fan blades mounted around the rotatable fan blade collar;

(c) a mist nozzle disposed inside the fan blade collar for dispensing mist therefrom, the collar being rotatable about a longitudinal axis of the nozzle, and the collar and nozzle being generally coaxial; and (d) a drive mechanism and a motor for rotating the fan blade collar through the drive mechanism, wherein an axis of rotation of a motor shaft of the motor is offset from an axis of rotation of the fan blade collar.

2. The misting fan as claimed in claim 1, further comprising a container and a pump coupled to the container for pumping liquid out of the container.

3. The misting fan as claimed in claim 1, further comprising a hose with one end being coupled to the nozzle, and the other end being connected to a pump.

4. The misting fan as claimed in claim 1, wherein the fan blade collar is rotatable around the nozzle which is disposed inside the fan blade collar.

* * * * *